US007810957B2

(12) United States Patent
Zeng et al.

(10) Patent No.: US 7,810,957 B2
(45) Date of Patent: Oct. 12, 2010

(54) LED LAMP ASSEMBLY

(75) Inventors: Jun-Hua Zeng, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 311 days.

(21) Appl. No.: 12/054,341

(22) Filed: Mar. 24, 2008

(65) Prior Publication Data

US 2009/0237934 A1 Sep. 24, 2009

(51) Int. Cl.
*F21V 29/00* (2006.01)

(52) U.S. Cl. ..... 362/294; 362/373; 362/249.02; 362/431

(58) Field of Classification Search ..... 362/373, 362/218, 249.02, 249.1, 249.11, 285, 431, 362/427, 249.03
See application file for complete search history.

(56) References Cited

U.S. PATENT DOCUMENTS

| | | | | |
|---|---|---|---|---|
| 4,164,784 | A * | 8/1979 | Jaksich | 362/282 |
| 5,825,637 | A * | 10/1998 | Chen | 362/417 |
| 6,273,585 | B1 | 8/2001 | Wu | |
| 7,438,448 | B2 * | 10/2008 | Chen | 362/373 |
| 7,458,706 | B1 * | 12/2008 | Liu et al. | 362/373 |

FOREIGN PATENT DOCUMENTS

| | | | |
|---|---|---|---|
| CN | 201003739 | Y | 1/2008 |

* cited by examiner

*Primary Examiner*—Sharon E Payne
(74) *Attorney, Agent, or Firm*—Frank R. Niranjan

(57) ABSTRACT

An LED lamp assembly includes an LED lamp and a supporting member supporting the LED lamp. The LED lamp includes a plurality of LED modules and a heat sink supporting and cooling the LED modules. The supporting member includes a pair of supporting arms supporting the LED lamp and pivotably engaging with the heat sink of the LED lamp. The heat sink is rotatable relative to the supporting arms of the supporting member to vary an illumination angle of the LED lamp assembly.

13 Claims, 4 Drawing Sheets

LED LAMP ASSEMBLY

BACKGROUND OF THE INVENTION

1. Field of the Invention

The present invention relates to an LED lamp assembly, and more particularly to an LED lamp assembly having an LED lamp which is rotatable to assume various angles of illumination.

2. Description of Related Art

The technology of light emitting diodes has rapidly developed in recent years from indicators to illumination applications. With the features of long-term reliability, environment friendliness and low power consumption, the LED is viewed as a promising alternative for future lighting products.

A conventional LED lamp comprises a heat sink and a plurality of LED modules having LEDs attached to an outer surface of the heat sink to dissipate heat generated by the LEDs. The outer surface of the heat sink generally is a plane and the LEDs are arranged close to each other. When the LED lamp works, the LEDs mounted on the planar outer surface of the heat sink only form a flat light source. However, once the LED lamp is fixed under a determined circumstance, a direction of a light emitted by the LED lamp cannot be changed to meet different requirements. Generally, when it is necessary to change the illumination direction, the LED lamp must be remounted or redesigned, which is unduly time-consuming and raises production costs.

Thus, it is desired to devise a new LED lamp assembly having an LED lamp whose illumination angle is adjustable to meet different requirements.

SUMMARY OF THE INVENTION

An LED lamp assembly includes an LED lamp and a supporting member supporting the LED lamp. The LED lamp includes a plurality of LED modules and a heat sink supporting and cooling the LED modules. The supporting member includes a pair of supporting arms supporting the LED lamp and pivotably engaging with the heat sink of the LED lamp. The heat sink is rotatable relative to the supporting arms of the supporting member to vary an illumination angle of the LED lamp assembly.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
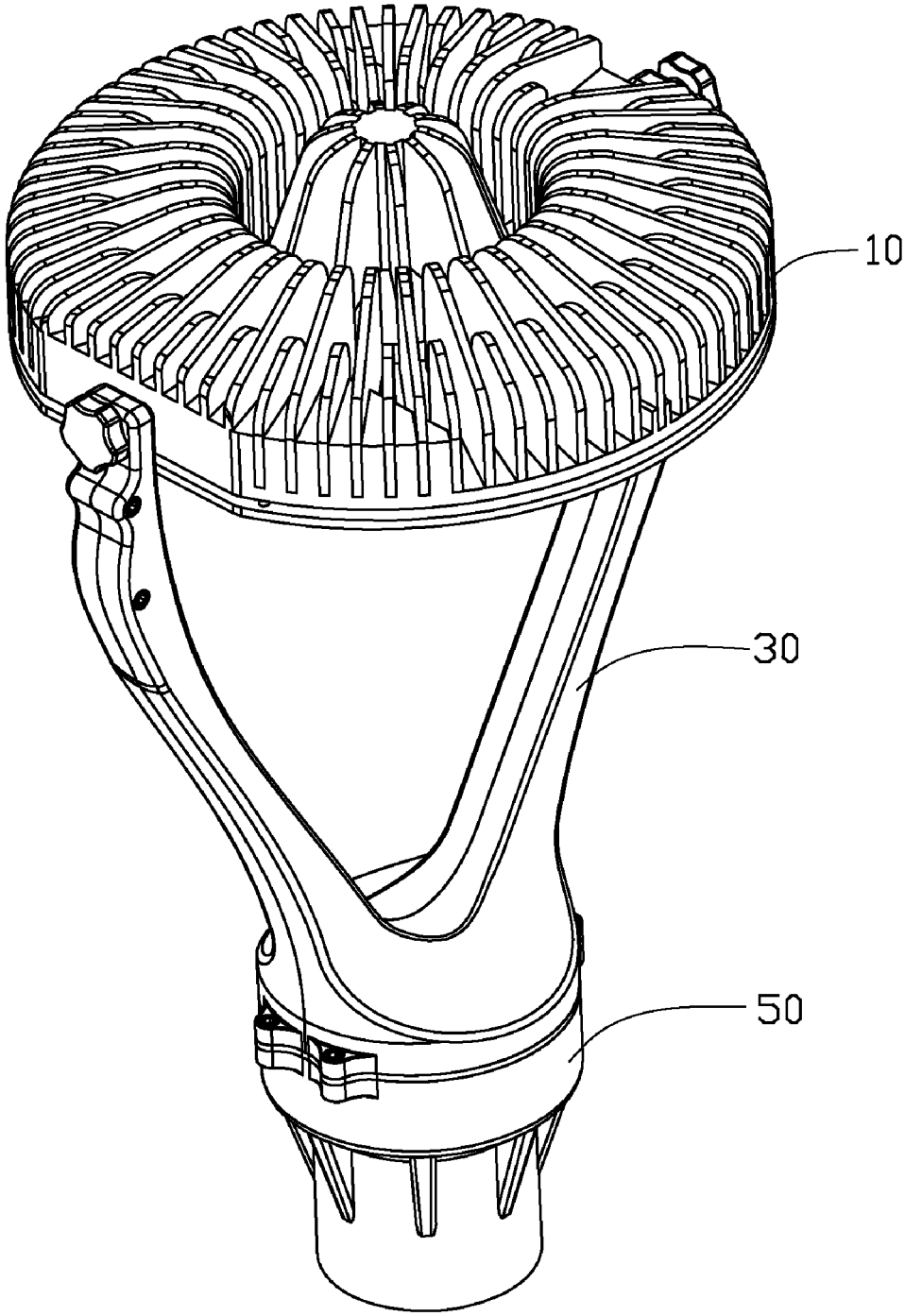
FIG. 1 is an assembled view of an LED lamp assembly with an LED lamp in accordance with a preferred embodiment of the present invention.
Figure 2:
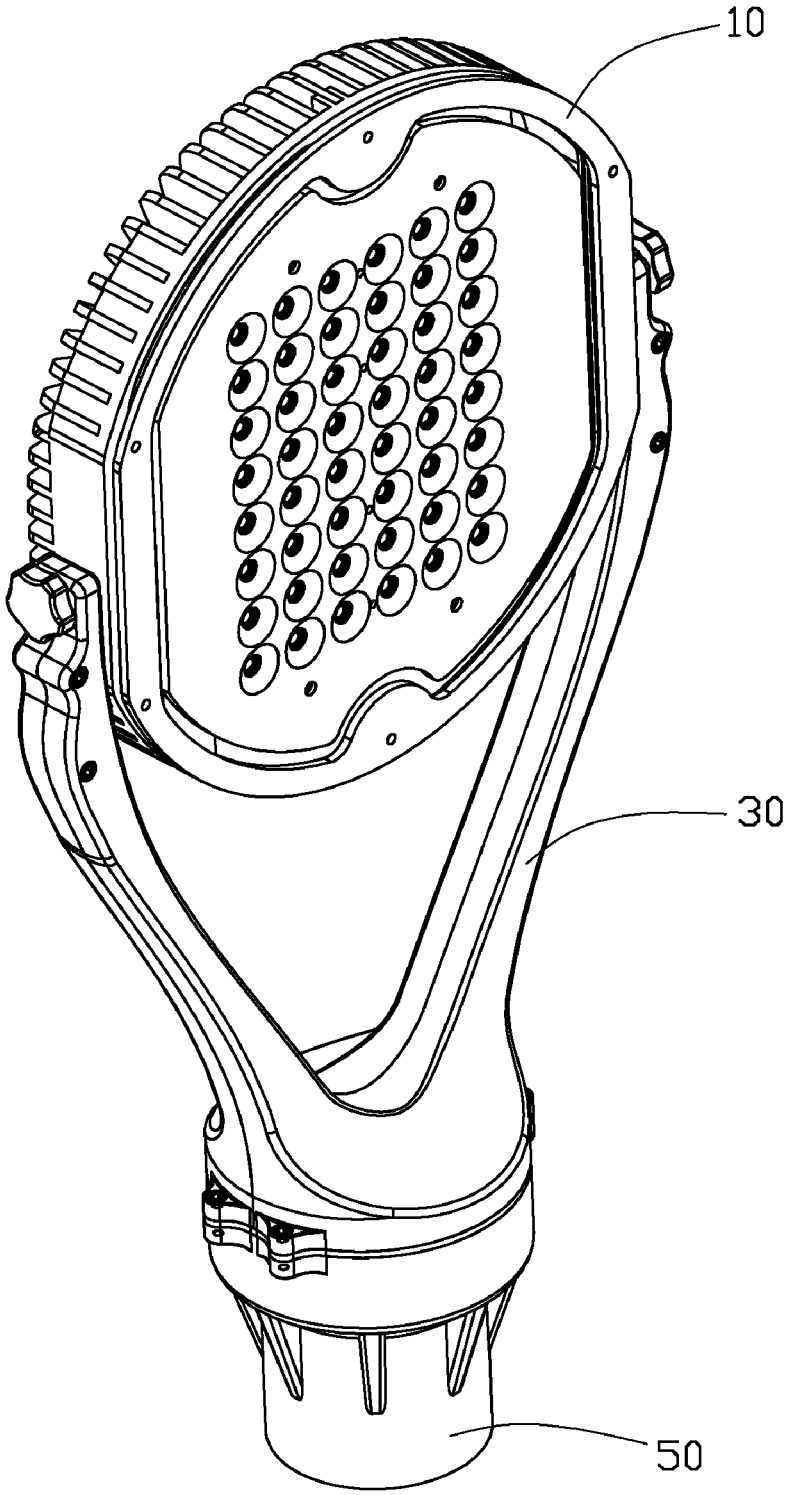
FIG. 2 is similar to FIG. 1, wherein the LED lamp rotates to a specifically determined angle.

Referring to FIGS. 1-2, an LED lamp assembly in accordance with a preferred embodiment of the present invention comprises an LED lamp 10, a supporting member 30 supporting the LED lamp 10 and a fixture 50. The supporting member 30 is mounted on the fixture 50. A driving circuit module (not shown) is received in the fixture 50 to electronically connect with the LED lamp 10. In addition, a supporting post (not shown) is connected to the fixture 50 to support the LED lamp assembly at a desired position.

Figure 3:
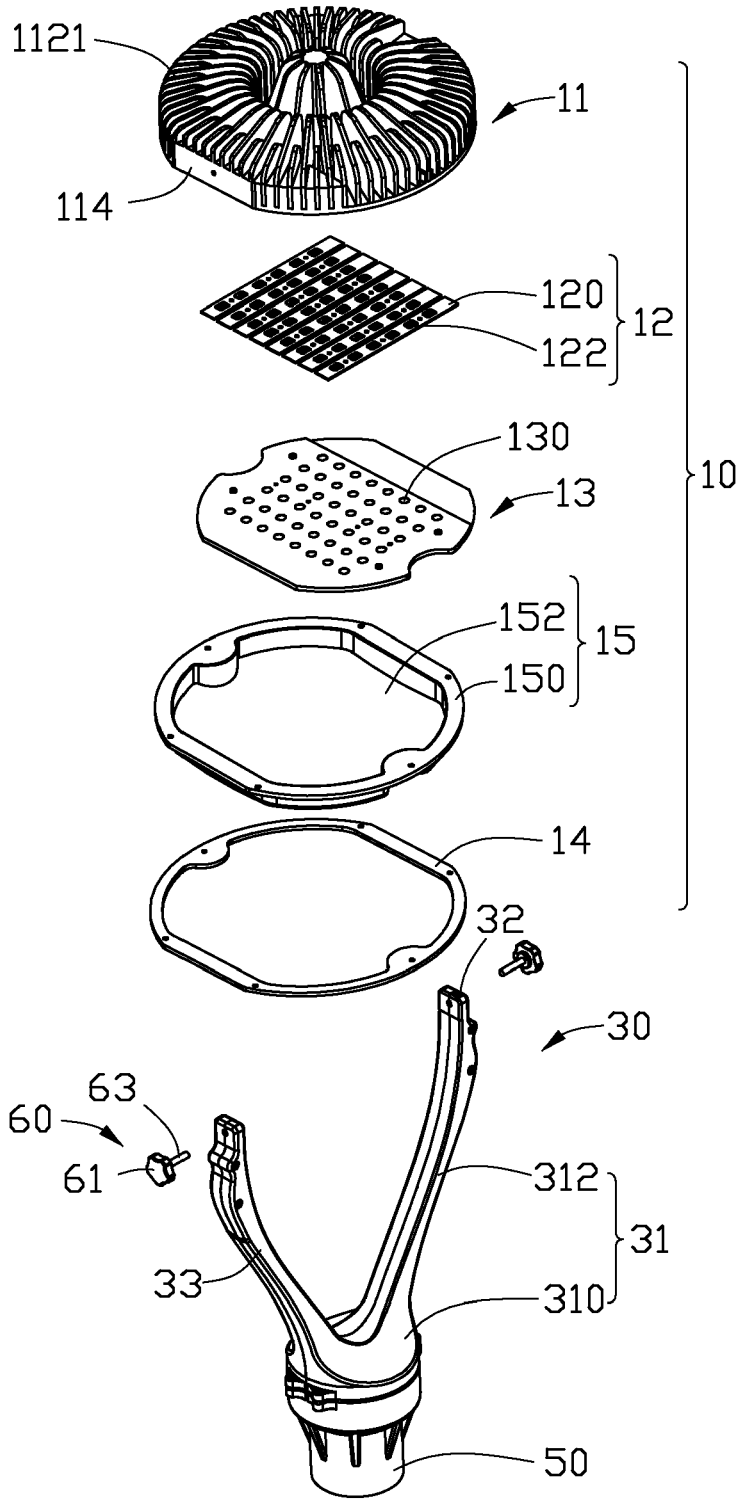
FIG. 3 is an exploded view of FIG. 1.
Figure 4:
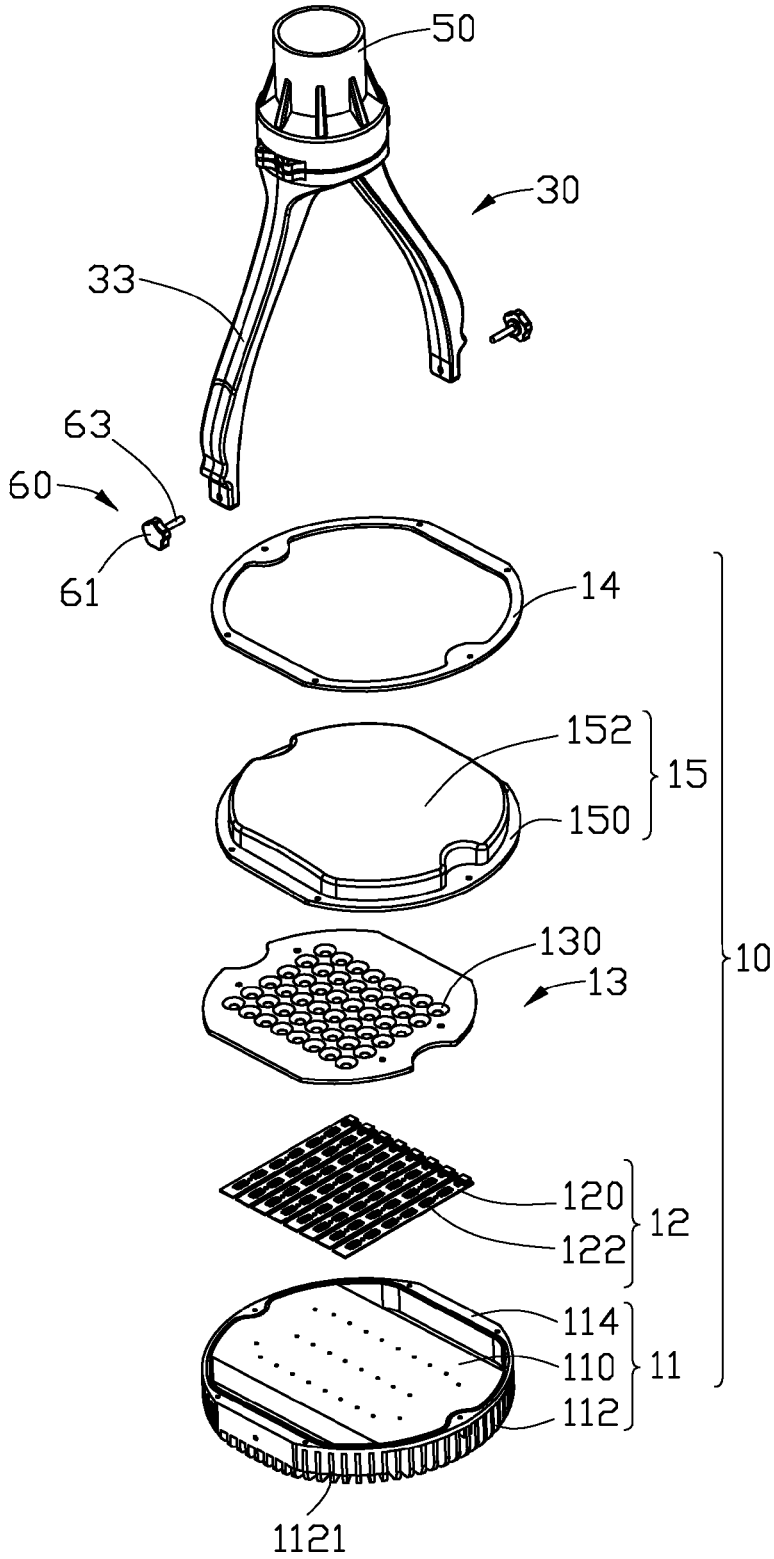
FIG. 4 is similar to FIG. 3, but viewed from a different aspect.

Referring to FIGS. 3-4 also, the LED lamp 10 comprises a plurality of LED modules 12, a heat sink 11 supporting and cooling the LED modules 12, a reflector 13 mounted on the heat sink 11 and spanning the LED modules 12, a transparent envelope 15 attached to the heat sink 11 and covering the reflector 13 and the LED modules 12 and a ring 14 pressing the envelope 15 toward the heat sink 11.

The heat sink 11 is supported by the supporting member 30. The heat sink 11 has a disc-shaped configuration, and is integrally made of aluminum. The heat sink 11 comprises a base 110 and a heat dissipating member 112 enclosing the base 110. The base 110 has a planar bottom surface (not labeled) for mounting the LED modules 12 and a top surface (not labeled) opposite to the bottom surface. The heat dissipating member 112 comprises a pair of arc-shaped sidewalls (not labeled) extending downwardly from opposite edges of the base 110. A pair of trapeziform mounting members 114 are located at opposite sides of the heat dissipating member 112 and connect with the sidewalls of the heat dissipating member 112. A thickness of each mounting member 114 is larger than that of the sidewall of the heat dissipating member 112. A plurality of fins 1121 is radiately mounted on the top surface of the base 110 and extends outwardly from the sidewalls of the heat dissipating member 112 to dissipate heat generated by the LED modules 12.

Each LED module 12 comprises an elongated printed circuit board 120 and a plurality of spaced LEDs 122 evenly mounted on a side of the printed circuit board 120. The LEDs 122 of each LED module 12 are arranged along a longitudinal direction of the printed circuit board 120. The LED modules 12 are equidistantly mounted on the bottom surface of the base 110 of the heat sink 11.

The reflector 13 is used to reflect light emitted by the LEDs 122 of the LED modules 12. The reflector 13 is an oval plate and defines a plurality of through holes 130 at a centre thereof. The LEDs 122 are received in the through holes 130. A plurality of screws (not shown) extends through the reflector 13 and engages with the base 110 of the heat sink 11 to mount the reflector 13 on the heat sink 11.

The envelope 15 is made of transparent glass or plastic. The envelope 15 comprises an oval transparent plate 152 and a mounting portion 150 extending from the plate 152. The ring 14 presses the envelope 15. A plurality of screws extends through the ring 14 and the mounting portion 150 of the envelope 15 to threadedly engage in the sidewalls and the mounting members 114 of the heat sink 11 to thereby mount the envelope 15 on the heat sink 11.

The supporting member 30 has a V-shaped configuration. The supporting member 30 is formed by a pair of V-shaped supporting portions 31. Each supporting portion 31 comprises a hollow, semi-circular connecting portion 310 and a pair of arc-shaped extending portions 312 extending slantwise and upwardly from opposite sides of the connecting portion 310. Each extending portion 312 defines a groove (not shown) at a centre thereof to receive wires (not shown) extending from the driving circuit module. The connecting portions 310 of the supporting portions 31 are oriented towards each other and mounted on the fixture 50. A plurality of screws (not labeled) extends through the extending portions 312 of the supporting portions 31 to assemble the extending portions 312 together; thus, a pair of supporting arms 33 are formed. The supporting arms 33 are symmetrical to each other relative to a central axis of the supporting member 30. The LED lamp 10 is supported by the supporting arms 33 of the supporting member 30. One of the supporting arms 33 defines a through hole 32 at a top thereof. The through hole 32 communicates with grooves of the extending portion 312. Wires of the driving circuit module extend in the supporting arm 33 and leave therefrom via the through hole 32 to enter the LED lamp 10 to electronically connect with the LED modules 12.

A pair of fasteners 60 extend through the supporting arms 33 of the supporting member 30 and the mounting members 114 of the heat sink 11 to assemble the LED lamp 10 and the supporting member 30 together. The fastener 60 comprises a head 61 and an elongated shaft 63 perpendicularly extending from the head 61. The shaft 63 terminates with a screwed end (not shown). When assembled, the screwed end of each of the shafts 63 screws into a corresponding mounting member 114 in a manner that the LED lamp 10 can be rotated relative to the supporting member 30 to change the illumination angle of the LED lamp 10. Once the illumination angle is determined, the fasteners 60 are further rotated to firmly engage with the mounting members 114 to make the LED lamp 10 be securely mounted on the supporting member 30. Thus, the LED lamp assembly is assembled together and the LED lamp 10 is oriented at the required direction.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp assembly comprising:

an LED lamp comprising a plurality of LED modules and a heat sink supporting and cooling the LED modules; and a supporting member supporting the LED lamp and comprising a pair of supporting arms pivotably engaging with the heat sink of the LED lamp;

wherein the heat sink is rotatable relative to the supporting arms of the supporting member to vary an illumination angle of the LED lamp;

wherein the heat sink has a disc-shaped configuration and comprises a base and heat dissipating member enclosing the base, the LED modules being attached on the base of the heat sink; and wherein the heat dissipating member comprises a pair of arc-shaped sidewalls extending downwardly from opposite edges of the base, and a pair of trapeziform mounting members located at opposite sides of the heat dissipating member and connecting with the sidewalls of the heat dissipating member, the supporting arms pivotably engaging with the mounting members of the heat sink of the LED lamp.

2. The LED lamp assembly as claimed in claim 1, wherein the supporting member has a V-shaped configuration and is formed by a pair of V-shaped supporting portions.

3. The LED lamp assembly as claimed in claim 2, wherein at least one of the supporting arms defines a through hole at a top thereof, adapted for electric wires in the supporting member to leave therefrom via the through hole to electronically connect with the LED modules.

4. The LED lamp assembly as claimed in claim 3, wherein each of the supporting portions has a V-shaped configuration and comprises a semi-circular connecting portion mounted on a fixture and a pair of arc-shaped extending portions extending slantwise and upwardly from opposite sides of the connecting portion, the extending portions being oriented towards each other and assembled together to form the supporting arms.

5. The LED lamp assembly as claimed in claim 4, wherein a pair of fasteners extend through the supporting arms of the supporting member and the heat sink of the LED lamp to assemble the supporting member and the LED lamp together, the LED lamp being rotatable relative to the supporting member.

6. The LED lamp assembly as claimed in claim 1, wherein a transparent envelope is located at a bottom of the heat sink and engages with the sidewalls and the mounting members of the heat sink to mount the envelope on the heat sink, the envelope covering the LED modules.

7. The LED lamp assembly as claimed in claim 1 further comprising a reflector covering the LED modules.

8. An LED lamp assembly comprising:

an LED lamp comprising a plurality of LED modules and a heat sink supporting and cooling the LED modules; and a supporting member supporting the LED lamp and comprising a pair of supporting arms pivotably engaging with the heat sink of the LED lamp;

wherein the heat sink is rotatable relative to the supporting arms of the supporting member to vary an illumination angle of the LED lamp;

wherein the heat sink has a disc-shaped configuration and comprises a base and heat dissipating member enclosing the base, the LED modules being attached on the base of the heat sink; and wherein a transparent envelope is located at a bottom of the heat sink and engages with the sidewalls and the mounting members of the heat sink to mount the envelope on the heat sink, the envelope covering the LED modules.

9. The LED lamp assembly as claimed in claim 8, wherein the supporting member has a V-shaped configuration and is formed by a pair of V-shaped supporting portions.

10. The LED lamp assembly as claimed in claim 9, wherein at least one of the supporting arms defines a through hole at a top thereof, adapted for electric wires in the supporting member to leave therefrom via the through hole to electronically connect with the LED modules.

11. The LED lamp assembly as claimed in claim 10, wherein each of the supporting portions has a V-shaped configuration and comprises a semi-circular connecting portion mounted on a fixture and a pair of arc-shaped extending portions extending slantwise and upwardly from opposite sides of the connecting portion, the extending portions being oriented towards each other and assembled together to form the supporting arms.

12. The LED lamp assembly as claimed in claim 11, wherein a pair of fasteners extend through the supporting arms of the supporting member and the heat sink of the LED lamp to assemble the supporting member and the LED lamp together, the LED lamp being rotatable relative to the supporting member.

13. The LED lamp assembly as claimed in claim 8 further comprising a reflector covering the LED modules.

* * * * *